US008965728B2

(12) United States Patent
Snider et al.

(10) Patent No.: US 8,965,728 B2
(45) Date of Patent: Feb. 24, 2015

(54) EXHAUST STRUT RADIAL TEMPERATURE MEASUREMENT

(75) Inventors: David August Snider, Simpsonville, SC (US); Harold Jordan, Greenville, SC (US); Christopher Holsonback, Greenville, SC (US)

(73) Assignee: General Electric Company, Schenectady, NY (US)

( * ) Notice: Subject to any disclaimer, the term of this patent is extended or adjusted under 35 U.S.C. 154(b) by 153 days.

(21) Appl. No.: 13/104,250

(22) Filed: May 10, 2011

(65) Prior Publication Data

US 2012/0290250 A1 Nov. 15, 2012

(51) Int. Cl.

| | |
|---|---|
| ***F01D 21/00*** | (2006.01) |
| ***F01D 25/30*** | (2006.01) |
| ***F01D 21/12*** | (2006.01) |

(52) U.S. Cl.

CPC ..... *F01D 21/003* (2013.01); *F01D 25/30* (2013.01); *F05D 2270/303* (2013.01)

USPC ..... 702/130; 702/131; 702/136

(58) Field of Classification Search

USPC ..... 702/34, 43, 130, 136; 416/97 R, 229, 416/244

See application file for complete search history.

(56) References Cited

U.S. PATENT DOCUMENTS

| | | | | |
|---|---|---|---|---|
| 2,698,872 | A * | 1/1955 | Broffitt | 136/224 |
| 4,765,751 | A * | 8/1988 | Pannone et al. | 374/143 |
| 6,595,062 | B1 * | 7/2003 | Luke et al. | 73/714 |
| 2004/0093147 | A1 * | 5/2004 | Kumar et al. | 701/100 |
| 2009/0228230 | A1 * | 9/2009 | Jammu et al. | 702/113 |

FOREIGN PATENT DOCUMENTS

| | | |
|---|---|---|
| JP | 2008/218449 | 8/2008 |

* cited by examiner

*Primary Examiner* — Michael Nghiem
*Assistant Examiner* — Ivan Rabovianski
(74) *Attorney, Agent, or Firm* — Nixon & Vanderhye P.C.

(57) ABSTRACT

A method is disclosed for providing a real time, radial exhaust temperature distribution in a gas turbine to improve the understanding of exhaust gas temperature in a manner similar to installing production rakes. The thermocouples are installed along the exhaust frame strut skins at a number of radial positions. The data from the thermocouples along each of the struts is used to produce a normalized radial profile of the turbine exhaust temperature. The existing turbine station instrumentation is then used to expand the normalized profile into an actual profile of the turbine exhaust temperature. The calculations/transfer functions for temperatures are obtained from data collected during performance testing with full rakes. This profile is integrated to determine a bulk Tx to improve gas turbine controls including model-based controls or corrected parameter controls (MBC/CPC) controls, or specific radial temperatures are used, to provide protective action for bucket platforms, or other turbine components.

29 Claims, 2 Drawing Sheets

EXHAUST STRUT RADIAL TEMPERATURE MEASUREMENT

The present invention relates to turbines, and more particularly, to measuring exhaust temperature distributions in gas turbines.

BACKGROUND OF THE INVENTION

With the advent of model-based controls for gas turbines, and an increasing emphasis on improving turbine performance and heat recovery steam generator ("HRSG") life and performance, it has become desirable to have a better understanding of the distribution of exhaust temperatures in gas turbines.

Currently, the existing instrumentation in gas turbine stations typically measures the exhaust temperature of a turbine at multiple positions circumferentially, but only at one position radially, in the turbine exhaust.

During the performance testing of gas turbines, it is common practice to place, at multiple circumferential positions around the exhaust frame of the turbine, exhaust temperature rakes that measure exhaust temperature at a number of radial positions in the turbine exhaust. These rakes measure a more complete distribution of the gas turbine's exhaust temperature, and can be used to define a correction to the gas turbine station's instrumentation measurement. However, these rakes are typically not robust enough to be used as long term, production instrumentation. The design of production rakes faces the challenge of being mechanically robust in a high temperature/flow environment, with concerns of dynamic responses. In addition, any such design must have a negligible impact on turbine performance.

BRIEF DESCRIPTION OF THE INVENTION

In an exemplary embodiment of the invention, a method of measuring the exhaust temperature distribution in a gas turbine comprises the steps of installing inside a skin of each of a plurality struts comprising the gas turbine's exhaust frame a plurality of thermocouples at a plurality of radial positions along each strut, collecting temperature data from each of the thermocouples within the skins of each of the struts, using the strut skin temperature data to calculate turbine exhaust gas flow path temperatures at each thermocouple installed inside the skins of the exhaust frame struts, using the exhaust gas flow path temperatures to produce a radial profile of the gas turbine's exhaust temperature, and using the radial profile of the gas turbine's exhaust temperature to improve the gas turbine control and to provide protective actions for selected turbine components.

In another exemplary embodiment of the invention, a method of measuring the exhaust temperature distribution in a gas turbine comprises the steps of installing inside a skin of each of a plurality struts comprising the gas turbine's exhaust frame a plurality of thermocouples at a plurality of radial positions along each strut, collecting temperature data from each of the thermocouples within the skins of each of the struts, using a transfer function to calculate from the strut skin temperature data turbine exhaust gas flow path temperatures at each thermocouple installed inside the skins of the exhaust frame struts, using regression analysis to produce from the exhaust gas flow path temperatures a normalized radial profile of the gas turbine's exhaust temperature, and using the normalized radial profile of the gas turbine's exhaust temperature with the existing station instrumentation measurement of exhaust temperature to produce an actual profile of the gas turbine's exhaust temperature.

In a further exemplary embodiment of the invention, a system for measuring the exhaust temperature distribution in a gas turbine comprises a plurality of thermocouples installed inside a skin of each of a plurality struts comprising the gas turbine's exhaust frame, the thermocouples being installed at a plurality of radial positions along each strut, and a computer system connected to the plurality of thermocouples, the computer system performing the steps of collecting temperature data from each of the thermocouples within the skins of each of the struts, using a transfer function to calculate from the strut skin temperature data turbine exhaust gas flow path temperatures at each thermocouple installed inside the skins of the exhaust frame struts, using regression analysis to produce from the exhaust gas flow path temperatures a normalized radial profile of the gas turbine's exhaust temperature, and using the normalized radial profile of the gas turbine's exhaust temperature with the existing station instrumentation measurement of exhaust temperature to produce an actual profile of the gas turbine's exhaust temperature.

DETAILED DESCRIPTION OF THE INVENTION

Figure 1:
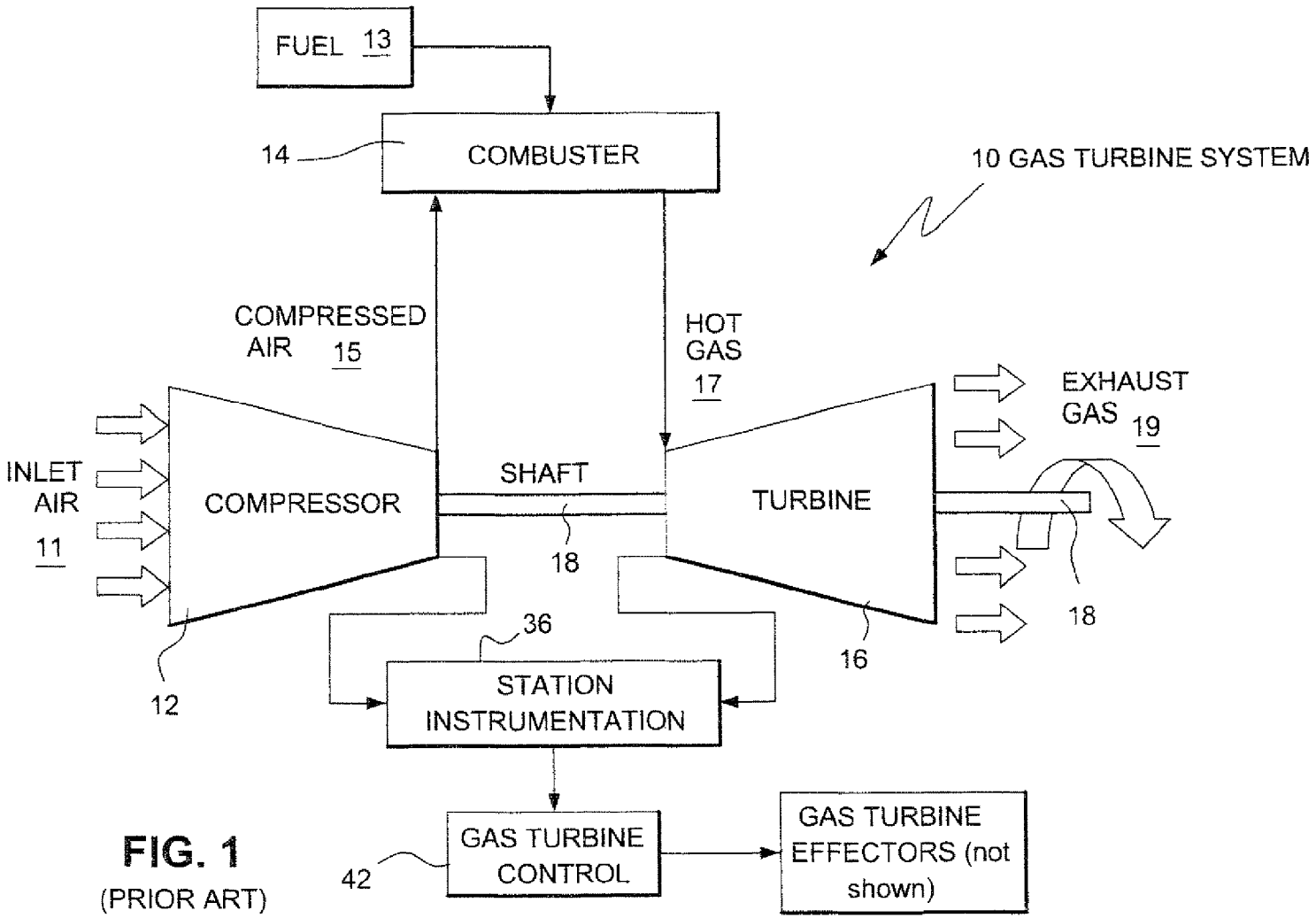
FIG. 1 (PRIOR ART)
FIG. 1 is a simple diagram showing the components of a typical gas turbine.

The present invention relates to providing a real time, radial exhaust temperature distribution at the exhaust frame of a gas turbine to improve the understanding of the bulk exhaust temperature or "Tx" and radial profile that is similar to that achieved when installing exhaust temperature rakes. Thermocouples are preferably installed inside the skins of the exhaust frame's struts at a number of radial positions. The data from the thermocouples in each strut is used to produce a normalized radial profile of the gas turbine's exhaust temperature. The existing station instrumentation is then used to expand the normalized radial profile into an actual profile of the gas turbine's exhaust temperature. The calculations/transfer functions for temperatures are verified, or calibrated during performance testing with full rakes. This profile is integrated to determine a bulk Tx to improve the Gas turbine control, including model-based controls or corrected parameter controls (MBC/CPC controls), or specific radial temperatures are used, to provide protective action for bucket platforms, or other turbine components.

The present invention relates to the measurement of the radial exhaust temperature distribution in turbines without the addition of temperature rakes. Rather, multiple thermocouples are applied at a number of radial positions along the struts of the exhaust frame of the turbine. For robust operation, these thermocouples measure the metal temperature inside the struts' skins. Thermocouple locations, however, could be inside or outside the struts, at the struts' leading and/or trailing edges. A transfer function is defined between the metal temperature and the flow path temperature based on turbine commissioning data taken from performance rakes and/or analysis. Given the limited number of exhaust struts, and the lobed nature of the circumferential profile, variation swirl, etc., the thermocouples are not used to define an absolute exhaust temperature profile. Rather, they are used to define a characteristic, or normalized radial profile that is expanded to the actual radial profile using the turbine's existing station instrumentation.

A transfer function is used to calculate flow path temperatures at each thermocouple installed inside or outside on the exhaust strut skins. Additional processing of the radial temperatures from all struts using, for example, regression analysis, is then used to produce a normalized radial temperature profile. This approach addresses concerns of the circumferential distribution and measuring the radial profile at a limited number of circumferential locations. The typical turbine station instrumentation is used to expand or calibrate the normalized profile, which can then be integrated into a bulk exhaust temperature, or could be fed into protective control loops to avoid excessive temperature at bucket platforms or for similar applications. Existing Tx measurements occur at one radial position, and a correction is applied to calculate a bulk exhaust temperature. This correction is not constant. It varies with load, combustor mode, etc. This approach potentially provides the same benefit of production exhaust rakes with lower cost, and much higher reliability. It establishes the corrections to be made on a real-time basis for any given cycle condition or combustor split. It also provides additional information to control systems relative to temperature at any radial location. When performance rakes are installed, each rake places a number of thermocouples (TCs) at different radial positions along the turbine exhaust frame. Typically, there are a significant number of rakes positioned circumferentially to measure the exhaust temperature. Typically, the exhaust temperature is non-uniform circumferentially due to the effects of discrete combustion cans, and it also varies radially due to the combustor exit profile. The performance rakes provide enough data throughout the flow field to allow the calculation of the average exhaust temperature.

The performance rakes provide an optimal measurement of Tx, but they are not robust enough for long term use. For long term instrumentation (or "station" instrumentation) typically single thermocouples are mounted in the exhaust flow at a single radial position, and at a large number (e.g., twenty seven) of circumferential positions. These account for circumferential temperature distributions, but do not capture radial distributions. To correct for the radial distribution, the average Tx from the performance rakes is compared to the average from the station instrumentation. This ratio is then used to correct the station measurement to be consistent with the more accurate measurement. The design of the station instrumentation tries to target a radial position where the measured temperature will also be the average temperature. Therefore the ratio is typically close to 1.0. The average exhaust temperature is typically used for gas turbine control and depends on this correction factor. Since the correction is typically determined empirically, near ISO day base load and a single value is used to provide the best understanding at base load. The ratio may vary with load, ambient temperature, degradation, firing temperature or other factors.

A thermocouple centered between struts of the exhaust frame at a given radial position would have a "clean" measurement of the exhaust gas temperature. Another thermocouple mounted on the outside of a strut at the same radial position, would have thermal and aero effects that may cause it measure a different, but related temperature to that measured by the centered thermocouple. A transfer function is used that would be, for example, a function of total mass flow and exhaust pressure. The transfer function is dependent on the axial and radial location of the thermocouples on the strut. Thus, for example, the transfer function for the leading edge of the strut could be different from the transfer function for the trailing edge of the strut.

In one embodiment, the thermocouple is mounted on the outside of the skin of the strut. In another embodiment, the thermocouple is mounted inside the skin of the strut. This embodiment is desirable for having more protected and durable instrumentation. In this embodiment, the metal temperature inside the strut has a relationship to the gas temperature outside of the strut, and, in turn, the clean exhaust temperature. A transfer function is then used to relate the two values.

In another embodiment, a composite of the thermocouples is used. Where the existing station instrumentation provides an accurate circumferential measurement at one radial location, an account for the radial distribution is needed. All the thermocouples on a single strut are used to define the radial profile at that strut. This profile is normalized, and all of the normalized profiles for all of the struts is averaged to define a normalized radial profile of exhaust gas temperature. The measured temperature at the radial position of the station instrumentation is used to expand the normalized radial profile for use in the as turbine control system. This embodiment is desirable, given the relatively low number of struts comprising the exhaust frame versus the number of combustion cans. This composite or normalized approach can be used with thermocouples at any location on or in a strut.

The transfer functions may be determined by analysis, but, typically, they are developed by testing.

FIG. 1 is a simple diagram showing the components of a typical gas turbine system 10. The gas turbine system 10 includes (i) a compressor 12, which compresses incoming air 11 to high pressure, (ii) a combustor 14, which burns fuel 13 so as to produce a high-pressure, high-velocity hot gas 17, and (iii) a turbine 16, which extracts energy from the high-pressure, high-velocity hot gas 17 entering the turbine 16 from the combustor 14, so as to be rotated by the hot gas 17. As the turbine 16 is rotated, a shaft 18 connected to the turbine 16 and compressor 12 is caused to be rotated as well. Finally, exhaust gas 19 exits the turbine 16. The cycle conditions at various locations in the gas turbine are measured by long term instrumentation referred to as station instrumentation 36. This instrumentation provides input to the gas turbine's control system 42 which will change the gas turbine effectors as defined in the control laws.

Figure 2:
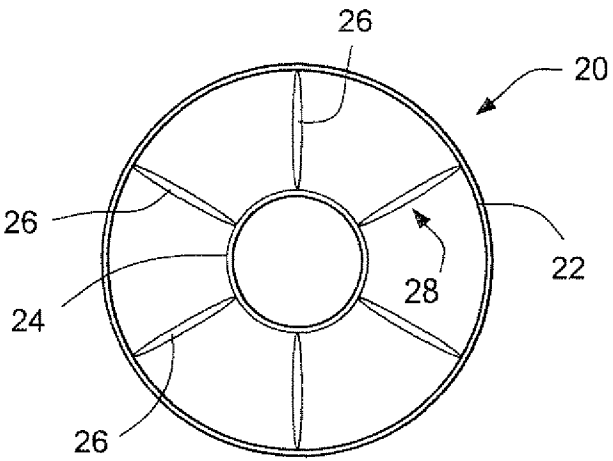
FIG. 2 (PRIOR ART)
FIG. 2 is a plan view of a typical gas turbine exhaust frame, looking aft, with the exhaust frame including a plurality of exhaust struts.

FIG. 2 is a plan view of turbine 16's exhaust frame 20, looking aft. The exhaust frame 20 consists of an outer cylinder 22 and an inner cylinder 24 interconnected by a plurality of radially extending struts 26. The exhaust frame 20 typically receives a flow of exhaust gas 19 from turbine 16's exhaust diffuser (not shown).

Figure 3:
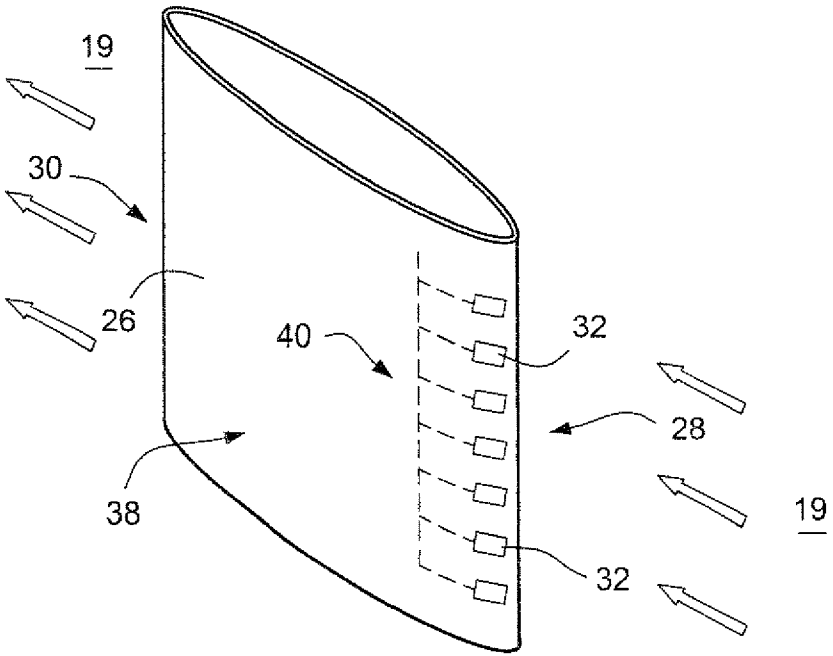
FIG. 3 is a partial perspective view of a strut that is part of a gas turbine exhaust frame.

In the exhaust frame 20 shown in FIG. 2, there are a total of six radially extending struts 26 interconnecting outer cylinder 22 and an inner cylinder 24. FIG. 3 is a partial perspective view in greater detail of one of the radially extending struts 26 interconnecting outer cylinder 22 and inner cylinder 24. Each of the struts 26 includes, relative to the exhaust gas 19 flowing from the turbine's exhaust diffuser, a leading edge 28 and a trailing edge 30.

A plurality of thermocouples 32 are installed along the skins 38 of the exhaust frame struts 26 at a number of positions extending radially from the inner cylinder 24. The thermocouples 32 shown in FIG. 3 are shown as being installed at multiple radial locations inside the skin 38 of each exhaust strut 26. The thermocouples 32 could be located, however, inside or outside the struts, and at the struts' leading and/or trailing edges. The thermocouple locations could also be a mixture of locations including inside and outside the struts, and at the struts' leading and trailing edges.

Temperature data from the thermocouples 32 in each of the struts 26 is used to produce a normalized radial profile of the exhaust temperature of turbine 16. The turbine's existing station instrumentation 36 is then used to expand the normalized profile into the actual profile of the turbine's exhaust temperature. For this purpose, the turbine's existing station instrumentation 36 preferably includes a suitable computer system, which may be the gas turbine control system 42 for performing calculations used to develop profiles of the exhaust temperature of turbine 16. The calculations/transfer functions for temperatures are verified, or calibrated during performance testing with full rakes. This profile is integrated to determine a bulk Tx to improve model-based controls or corrected parameter controls (MBC/CPC) controls, or specific radial temperatures are used, to provide protective action for turbine bucket platforms, etc.

Although not specifically shown in FIG. 1, computer system 42 would typically include a central processing unit (CPU) and system bus that would couple various computer components to the CPU. The system buses may be any of several types of bus structures, including a memory bus or memory controller, a peripheral bus, and a local bus using any of a variety of bus architectures. The memory used by computer system 42 would also typically include random access memory (RAM) and one or more hard disk drives that read from and write to, (typically fixed) magnetic hard disks. A basic input/output system (BIOS), containing the basic routines that help to transfer information between elements within a computer system, such as during start-up, may also be stored in read only memory (ROM). Computer system 42 might also include other types of drives for accessing other computer-readable media, such as removable "floppy" disks, or an optical disk, such as a CD ROM. The hard disk, floppy disk, and optical disk drives are typically connected to a system bus by a hard disk drive interface, a floppy disk drive interface, and an optical drive interface, respectively. The drives and their associated computer-readable media provide nonvolatile storage of computer-readable instructions, data structures, program modules, and other data used by machines, such as computer system 42. Computer system 42 will also include an input/output (I/O) device (not shown) and/or a communications device (not shown) for connecting to external devices, such as thermocouples 32. Such I/O and communications devices may be internal or external, and are typically connected to the computer's system bus via a serial or parallel port interface. Computer system 42 may also include other typical peripheral devices, such as printers, displays and keyboards. Typically, computer system 42 would include a display monitor (not shown), on which various information is displayed.

The method of the present invention for measuring exhaust temperature distribution in turbines improves the measurement of the radial temperature distribution without the addition of temperature rakes. Rather, multiple thermocouples 32 are applied at a number of radial positions along the struts 26 of the exhaust frame 20 of the turbine 16. For robust operation, these thermocouples 32 measure the metal temperature inside the struts' skins 38. A transfer function is used to determine the difference between the metal temperature and the flow path temperature based on performance data from performance rakes and/or analysis. Given the limited number of exhaust struts 26, and lobed nature of the circumferential profile, variation swirl, etc., the thermocouples 32 are not used to define an absolute exhaust temperature. Rather, they are used to define a normalized radial profile that is used with the existing station instrumentation to calculate an actual radial profile.

A transfer function is used to calculate flow path temperatures at each thermocouple 32. Additional processing (e.g., regression analysis or the like) of the radial temperatures from all struts 26 produces a normalized radial temperature profile. This approach addresses concerns of the circumferential distribution and measuring the radial profile at a limited number of circumferential locations. The station instrumentation 36 is used to expand or calibrate the normalized profile, which is then integrated into a bulk exhaust temperature, or could fed into protective control loops to avoid excessive temperature at bucket platforms or similar applications. Existing Tx measurements occur at one radial position, and a correction is applied to calculate a bulk exhaust temperature. That correction is not constant. It varies with load, combustor mode, etc. This approach potentially provides the same benefit of production exhaust rakes with lower cost, and much higher reliability. It establishes that corrections can be made on a real-time basis, for any given cycle condition or combustor split. It also provides additional information to control systems relative to temperature at any radial location.

The method of the present invention achieves reliable data equivalent to a production rake by:

placing the thermocouples inside an existing structural strut (no performance loss, protects the thermocouples);

normalizing the profile to offset the limited number of struts;

using a transfer function to account for deltas between exhaust gas temperature and metal temperatures; and using existing station instrumentation with the strut thermocouples to expand the profile to an actual Tx profile.

Potential benefits of the present method include improved control of emissions, improved hot gas path and HRSG life, increased peak fire capability by adjusting splits to minimize temperature at critical locations.

Technical advantages of the present method include improved input to model based control systems to improve model tuning and improved understanding of Tx into the HRSG.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of measuring an exhaust temperature distribution at a gas turbine exhaust frame comprised of a plurality of radially extending struts, the method comprising:

for each strut of the plurality of struts, mounting a plurality of thermocouples on a skin of the strut at a plurality of positions extending radially along a longitudinal length of the strut, for each strut of the plurality of struts, obtaining data related to strut skin temperature from each of the thermocouples mounted on the skin of the strut, for each strut of the plurality of strut, using the strut skin temperature related data obtained from the thermocouples mounted on the skin of the strut to obtain turbine exhaust gas flow path temperatures at the thermocouples mounted on the skin along the longitudinal length of the struts, using the turbine exhaust gas flow path temperatures to produce an actual profile of gas turbine exhaust temperature at the gas turbine exhaust frame to thereby measure the exhaust temperature distribution at the gas turbine exhaust frame.

2. The method of claim 1, wherein a transfer function is used to calculate the turbine exhaust gas flow path temperatures from the strut skin temperature related data.

3. The method of claim 2, wherein regression analysis is used to produce a normalized radial temperature profile of gas turbine exhaust temperature from the turbine exhaust gas flow path temperatures.

4. The method of claim 3, wherein gas turbine station instrumentation is used to expand the normalized radial profile into the actual profile of the gas turbine exhaust temperature.

5. The method of claim 2, wherein the calculated turbine exhaust gas flow path temperatures and the transfer function used to calculate the turbine exhaust gas flow path temperatures are based on data obtained during performance testing of the turbine with temperature rakes.

6. The method of claim 1, wherein the actual profile of the gas turbine exhaust temperature is integrated to determine a bulk Tx to be input to a gas turbine control system so as to provide improved gas turbine control.

7. The method of claim 1 wherein the actual profile of gas turbine exhaust temperature is used as input to a gas turbine control system so as to provide protective action for selected turbine components.

8. The method of claim 7, wherein the selected turbine components are turbine buckets.

9. The method of claim 1, wherein, for each strut of the plurality of struts, the thermocouples are mounted on an inside of the skin of the strut at a leading edges of the strut.

10. The method of claim 1, wherein, for each strut of the plurality of struts, the thermocouples are mounted on an inside of the skin of the strut at a trailing edges of the struts.

11. The method of claim 1, wherein, for each strut of the plurality of struts, the thermocouples are mounted on an outside of the skin of the strut at a leading edge of the strut.

12. The method of claim 1, wherein, for each strut of the plurality of struts, the thermocouples are mounted on an outside of the skin of the strut at a trailing edge of the strut.

13. A method of measuring an exhaust temperature distribution at a gas turbine exhaust frame comprised of a plurality of radially extending struts, the method comprising:

for each strut of the plurality of struts, mounting a plurality of thermocouples on a skin of the strut at a plurality of positions extending radially along a longitudinal length of the strut, for each strut of the plurality of struts, obtaining data relating to strut skin temperature from each of the thermocouples mounted on the skin of the strut, for each strut of the plurality of struts, using a transfer function to calculate, from the strut skin temperature related data obtained from the thermocouples mounted on the skin the strut, turbine exhaust gas flow path temperatures at the thermocouples mounted on the skin along the longitudinal length of the strut, using regression analysis to produce from the turbine exhaust gas flow path temperatures a normalized radial profile of gas turbine exhaust temperature at the gas turbine exhaust frame, and using the normalized radial profile of the gas turbine exhaust temperature to produce an actual profile of the gas turbine exhaust temperature at the gas turbine exhaust frame to thereby measure the exhaust temperature distribution at the gas turbine exhaust frame.

14. The method of claim 13, wherein gas turbine station instrumentation is used to expand the normalized radial profile into the actual profile of the gas turbine's exhaust temperature.

15. The method of claim 13, wherein the calculated turbine exhaust gas flow path temperatures and the transfer function used to calculate the turbine exhaust gas flow path temperatures are based on data obtained during performance testing of the turbine with temperature rakes.

16. The method of claim 13, wherein the actual profile of the gas turbine exhaust temperature is used to define a correction to a gas turbine station instrumentation measurement of the gas turbine exhaust temperature.

17. The method of claim 13, wherein, for each strut of the plurality of struts, the thermocouples are mounted on an inside of the skin of the struts at a leading edge of the strut.

18. The method of claim 13, wherein, for each strut of the plurality of struts, the thermocouples are mounted on an inside of the skin of the strut at a trailing edge of the strut.

19. The method of claim 13, wherein, for each strut of the plurality of struts, the thermocouples are mounted on an outside of the skin of the strut at a leading edge of the strut.

20. The method of claim 13, wherein, for each strut of the plurality of struts, the thermocouples are mounted on an outside of the skin of the strut at a trailing edge of the strut.

21. The method of claim 13, wherein the thermocouples are mounted at a mixture of strut locations, including inside and outside of the struts, and at leading and trailing edges of the struts.

22. A system for measuring the exhaust temperature distribution at a gas turbine exhaust frame, the system comprising:

a plurality of radially extending struts comprising the gas turbine exhaust frame, for each strut of the plurality of struts, a plurality of thermocouples mounted on a skin of the strut at a plurality of positions extending radially along a longitudinal length of the strut, and a computer system connected to the plurality of thermocouples, the computer system performing the steps of:

for each strut of the plurality of struts, obtaining data related to strut skin temperature from each of the thermocouples mounted on the skin of the strut, for each strut of the plurality of struts, using a transfer function to calculate, from the strut skin temperature related data obtained from the thermocouples mounted on the skin of the strut, turbine exhaust gas flow path temperatures at each thermocouple mounted on the skin along the longitudinal length of the strut, using regression analysis to produce from the turbine exhaust gas flow path temperatures a normalized radial profile of gas turbine exhaust temperature at the gas turbine exhaust frame, and using the normalized radial profile of the gas turbine exhaust temperature to produce an actual profile of the gas turbine exhaust temperature at the gas turbine exhaust frame to thereby measure the exhaust temperature distribution at the gas turbine exhaust frame.

23. The system of claim 22, wherein the computer system is part of a gas turbine control system.

24. The system of claim 22, wherein, for each strut of the plurality of struts, the thermocouples are mounted on an inside of the skin of the strut at a leading edge of the strut.

25. The system of claim 22, wherein, for each strut of the plurality of struts, the thermocouples are mounted on an inside of the skin of the strut at a trailing edge of the strut.

26. The system of claim 22, wherein, for each strut of the plurality of strut, a thermocouples are mounted on an outside of the skin of the strut at a leading edge of the strut.

27. The system of claim 22, wherein, for each strut of the plurality of struts, the thermocouples are mounted on an outside of the skin of the strut at a trailing edge of the strut.

28. The system of claim 22, wherein the thermocouple are mounted at a mixture of strut locations, including inside and outside surfaces of the struts, and leading and trailing edges of the struts.

29. The system of claim 22, wherein the calculated turbine exhaust gas flow path temperatures and the transfer function used to calculate the turbine exhaust gas flow path temperatures are based on data obtained during performance testing of the turbine with temperature rakes.

* * * * *

UNITED STATES PATENT AND TRADEMARK OFFICE

CERTIFICATE OF CORRECTION

PATENT NO. : 8,965,728 B2
APPLICATION NO. : 13/104250
DATED : February 24, 2015
INVENTOR(S) : Snider et al.

It is certified that error appears in the above-identified patent and that said Letters Patent is hereby corrected as shown below:

In the Specification:

At column 4, line 23, change “as turbine control system” to --gas turbine control system--

In the Claims:

In Claim 1 at column 6, line 60, “plurality of strut,” to --plurality of struts,--

In Claim 1 at column 6, line 65, “struts,” should read --strut,--

In Claim 9 at column 7, line 33, change “a leading edges” to --a leading edge--

In Claim 26 at column 9, line 2, change “plurality of strut, a” to --plurality of struts, the--

Signed and Sealed this
Fourteenth Day of July, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,965,728 B2
APPLICATION NO. : 13/104250
DATED : February 24, 2015
INVENTOR(S) : Snider et al.

It is certified that error appears in the above-identified patent and that said Letters Patent is hereby corrected as shown below:

IN THE SPECIFICATION

At Column 5, line 29, reads --from and write to, (typically fixed) magnetic hard disk--, should read "from, and write to, (typically fixed) magnetic hard disk"

IN THE CLAIMS

At Column 7, line 36, reads --inside of the skin of the strut at a trailing edges of the struts--, should read "inside of the skin of the strut at a trailing edge of the strut"

Signed and Sealed this
Thirteenth Day of October, 2015

Michelle K. Lee

Michelle K. Lee
*Director of the United States Patent and Trademark Office*